US007077212B2

(12) United States Patent
Roesner et al.

(10) Patent No.: US 7,077,212 B2
(45) Date of Patent: Jul. 18, 2006

(54) METHOD OF HYDRAULICALLY ACTUATING AND MECHANICALLY ACTIVATING A DOWNHOLE MECHANICAL APPARATUS

(75) Inventors: Thomas Roesner, Katy, TX (US); Scott McIntire, Houston, TX (US); Adrian Vuyk, Jr., Houston, TX (US); Thomas F. Bailey, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 251 days.

(21) Appl. No.: 10/251,635

(22) Filed: Sep. 20, 2002

(65) Prior Publication Data

US 2004/0055755 A1 Mar. 25, 2004

(51) Int. Cl.
*E21B 33/1295* (2006.01)

(52) U.S. Cl. ..... 166/382; 166/387; 166/120; 166/134

(58) Field of Classification Search ..... 166/387, 166/382, 383, 217, 212, 120, 121, 134
See application file for complete search history.

(56) References Cited

U.S. PATENT DOCUMENTS

| | | | | |
|---|---|---|---|---|
| 2,359,067 | A | 9/1944 | Warren | |
| 3,595,326 | A | 7/1971 | Claycomb | |
| 4,224,987 | A * | 9/1980 | Allen | 166/120 |
| 4,554,981 | A | 11/1985 | Davies | |
| 4,566,540 | A | 1/1986 | Pringle et al. | |
| 4,648,470 | A | 3/1987 | Gambertoglio | |
| 4,712,615 | A | 12/1987 | Dockins, Jr. et al. | |
| 4,781,536 | A | 11/1988 | Hicks | |
| 5,101,904 | A | 4/1992 | Gilbert | |
| 5,170,844 | A | 12/1992 | George et al. | |
| 5,180,015 | A | 1/1993 | Ringgenberg et al. | |
| 5,193,620 | A | 3/1993 | Braddick | |
| 5,320,183 | A * | 6/1994 | Muller et al. | 166/387 |
| 5,411,097 | A | 5/1995 | Manke et al. | |
| 5,443,129 | A | 8/1995 | Bailey et al. | |
| 5,553,671 | A | 9/1996 | Sieber | |
| 5,771,972 | A | 6/1998 | Dewey et al. | |
| 5,775,428 | A | 7/1998 | Davis et al. | |

(Continued)

FOREIGN PATENT DOCUMENTS

EP 0 539 020 A1 4/1993

(Continued)

OTHER PUBLICATIONS

U.K. Search Report, Application No. GB 0322101.7, dated Jan. 27, 2004.

(Continued)

*Primary Examiner*—Jennifer H. Gay
*Assistant Examiner*—Giovanna M. Collins
(74) *Attorney, Agent, or Firm*—Patterson & Sheridan, LLP

(57) ABSTRACT

The present invention generally relates to an apparatus and method for operating a tool in a wellbore. In one aspect, the apparatus includes a hydraulically operated tool and a wellbore tubular both in communication with a pressure sensing line. The hydraulically operated tool is responsive to a combination of a fluid pressure in the pressure sensing line and a manipulation of the wellbore tubular, such response causing the tool to operate within the wellbore. In another aspect, the invention provides a method for anchoring a well tool in a wellbore. The method includes the steps of lowering the well tool into the wellbore on a tubular string, flowing fluid through the tubular string to begin anchoring the well tool, and manipulating the tubular string to complete the anchoring of the well tool.

20 Claims, 14 Drawing Sheets

U.S. PATENT DOCUMENTS

| | | | | |
|---|---|---|---|---|
| 5,791,417 | A * | 8/1998 | Haugen et al. | 166/298 |
| 5,947,201 | A | 9/1999 | Ross et al. | |
| 6,050,334 | A | 4/2000 | McGarian et al. | |
| 6,116,336 | A * | 9/2000 | Adkins et al. | 166/55.7 |
| 6,305,474 | B1 | 10/2001 | Roberts et al. | |
| 6,364,037 | B1 | 4/2002 | Brunnert et al. | |

FOREIGN PATENT DOCUMENTS

| | | |
|---|---|---|
| EP | 0 994 238 A2 | 4/2000 |
| GB | 2 303 158 A | 2/1997 |
| GB | 2 338 256 | 12/1999 |
| WO | WO 99/47789 | 9/1999 |
| WO | WO 99/64715 | 12/1999 |

OTHER PUBLICATIONS

U.K. Examination Report, Application No. GB0322101.7, dated Jun. 7, 2005.

* cited by examiner

METHOD OF HYDRAULICALLY ACTUATING AND MECHANICALLY ACTIVATING A DOWNHOLE MECHANICAL APPARATUS

BACKGROUND OF THE INVENTION

1. Field of the Invention

This invention relates generally to a method and an apparatus for operating a tool in a wellbore. More particularly, the invention relates to positioning a tool in a wellbore and setting the tool in a fixed position. Still more particularly, the invention relates to actuation of a downhole hydraulic tool by an actuation apparatus that uses a pressure differential in a conduit carrying a fluid flow to actuate the downhole hydraulic tool.

2. Description of the Related Art

Hydraulically-actuated tools such as packers and anchor assemblies have long been used in the drilling industry. A tool often used in conjunction with anchors or packers is a deflector, which is commonly called a whipstock. A deflector includes an inclined face and is typically used to direct a drill bit or cutter in a direction that deviates from the existing wellbore. The combination deflector and anchor (or packer) is frequently termed a sidetrack system. Sidetrack systems have traditionally been used to mill a window in the well casing, and thereafter to drill through the casing window and form the lateral wellbore.

Originally, such a sidetrack operation required two trips of the drill string. The first trip was used to run and set the anchor or packing device at the appropriate elevation in the wellbore. With the anchor or packer in place, the drill string was then removed from the well and a survey was made to determine the orientation of a key on the upper end of the anchor-packer. With that orientation known, the deflector was then configured on the surface so that when the deflector engaged the anchor-packer in the wellbore, it would be properly oriented. So configured, the deflector, along with an attached cutter, was then lowered in the wellbore on the drill string and secured to the anchor-packer. Once connected to and supported by the packer, the deflector directed the cutter so that a window would be milled in the casing of the wellbore at the desired elevation and in the preselected orientation. This two-trip operation for setting the anchor-packer and then lowering the deflector and cutter is time-consuming and expensive, particularly in very deep wells.

To eliminate the expense associated with two trips of the drill string, an improved sidetrack system was developed which required only a single trip. Such a system includes a deflector having an anchor-packer connected at its lower end, and a cutter assembly at its upper end connected by a shearable connection. Using such a system, the deflector is oriented by first lowering the apparatus into the cased wellbore on a drill string. A wireline survey instrument is then run through the drill string to check for the proper orientation of the suspended deflector. After the deflector is properly oriented in the wellbore, and the anchor-packer set, the drill string is then lowered causing the cutter assembly to become disconnected from the deflector. As the cutter is lowered further, the inclined surface of the deflector urges the rotating cutter against the well casing, causing the cutter to mill a window in the casing at the predetermined orientation and elevation.

To be contrasted with wireline devices, there exist today a variety of systems that are capable of collecting and transmitting data from a position near the drill bit while drilling is in progress. Such measuring-while-drilling ("MWD") systems are typically housed in a drill collar at the lower end of the drill string. In addition to being used to detect formation data, such as resistivity, porosity, and gamma radiation, all of which are useful to the driller in determining the type of formation that surrounds the wellbore, MWD tools are also useful in surveying applications, such as, in determining the direction and inclination of the drill bit. Present MWD systems typically employ sensors or transducers which, while drilling is in progress, continuously or intermittently gather the desired drilling parameters and formation data and transmit the information to surface detectors by some form of telemetry, most typically a mud pulse system. The mud pulse system creates acoustic signals in the drilling mud that is circulated through the drill string during drilling operations. The information acquired by the MWD sensors is transmitted by suitably timing the formation of pressure pulses in the mud stream. The pressure pulses are received at the surface by pressure transducers that convert the acoustic signals to electrical pulses, which are then decoded by a computer.

MWD tools presently exist that can detect the orientation of the drill string without the difficulties and drawbacks described above that are inherent with the use of wireline sensors. However, known MWD tools typically require drilling fluid flow rates of approximately 250 gallons per minute to start the tool, and 350 to 400 gallons per minute to gather the necessary data and transmit it to the surface via the mud pulse telemetry system. The conventional bypass valves used in present-day sidetrack systems for circulating drilling fluid and transporting a wireline sensor to the deflector tend to close, and thereby actuate the anchor-packer, at flow rates of approximately 100 gallons per minute, or even less. Thus, while it might be desirable to combine MWD sensors in a sidetrack system, if drilling mud was circulated through the drill string at the rate necessary for the MWD tool to detect and communicate to the driller the orientation of the deflector, the bypass valve would close and the anchor-packer would be set prematurely, before the deflector was properly oriented. As described in the following paragraphs, there are several different methods for setting a downhole tool such as an anchor-packer.

An improved apparatus for setting a hydraulically actuated downhole tool in a wellbore is disclosed in Bailey, U.S. Pat. No. 5,443,129, which is incorporated herein by reference in its entirety. The '129 apparatus utilizes a bypass valve located in the run-in string below the MWD device and above the cutter. The valve is in an open position while the MWD device is operating thereby diverting fluid flow and pressure from the tubular to the annulus without creating a pressure sufficient to actuate a downhole tool. Upon completion of operation of the MWD device, the bypass valve is remotely closed. Thereafter, selectively operable ports in the cutter are opened and the tubular therebelow is pressurized to a point necessary to actuate the tool. While the apparatus of the '129 patent allows operation of a MWD device without the inadvertent actuation of a downhole tool, the bypass valve is complex requiring many moving parts and prevents the continuous flow of fluid through the cutter. Additionally, the bypass valve may not function properly in a wellbore that contains little or no fluid. Finally, the fluid borne sediment tends to settle and collect in the cutter.

An apparatus to actuate a downhole tool is disclosed in Brunnert, U.S. Pat. No. 6,364,037, which is incorporated herein by reference in its entirety. The '037 invention provides an apparatus for actuating a downhole tool by utilizing a pressure differential created by fluid flowing through a conduit. The conduit is in communication with a pressure sensing line that is selectively exposed to areas of the conduit having different pressures. By exposing the pressure sensing line to a portion of the conduit having a predetermined pressure therein, the pressure sensing line causes actuation of a hydraulic tool therebelow. While the apparatus of the '037 patent allows operation of a MWD device without the inadvertent actuation of a downhole tool, the apparatus is complex requiring many moving parts.

A whipstock setting apparatus is disclosed in Braddick, U.S. Pat. No. 5,193,620, which is incorporated herein by reference in its entirety. The '620 invention provides a whipstock setting apparatus that includes a whipstock and a mandrel. A downhole tool including a mechanical weight set packer and upper and lower cone and slip means are mounted on the mandrel above and below the downhole tool. The mandrel is releasably connected to the downhole tool to prevent premature longitudinal movement while accommodating the relative longitudinal movement at a predetermined point. The components of the whipstock assembly and downhole tool are secured to maintain alignment with the face of the whipstock while lowering the whipstock in the well tubular member. Thereafter, the mandrel is released and the whipstock is oriented in the well tubular member. Subsequently, the oriented whipstock and downhole tool are mechanically anchored in the well tubular member by longitudinal movement of the work string. While the apparatus of the '620 patent actuates the downhole tool without any complex hydraulic mechanism, the manipulation of the piping string to initiate the sequence of events to set the whip stock setting apparatus may not be effective in a deviated wellbore due to the angle of the wellbore and frictional problems.

A one-trip whipstock milling system is disclosed in Ross, U.S. Pat. No. 5,947,201, which is incorporated herein by reference in its entirety. The '201 invention provides a bottomhole assembly that includes a whipstock milling system, a downhole tool, a whipstock and orientation instrumentation. After the bottomhole assembly is located in the wellbore, the wellbore is pressurized to actuate the downhole tool. Thereafter, the milling operation cuts a window in the surrounding casing. While the apparatus of the '201 patent actuates the downhole tool without a complex hydraulic mechanism or mechanical manipulation of the piping string, the pressurizing of the wellbore is very costly and will not operate properly if there is little or no fluid in the wellbore.

There is a need therefore, for a single trip sidetrack apparatus permitting a continuous flow of well fluid therethrough while allowing the actuation of a hydraulically actuated tool at a predetermined position in the borehole. There is a further need therefore, for a single trip sidetrack apparatus that does not depend on a value to prevent inadvertent actuation of a downhole tool. There is a further need for an actuation apparatus that allows fluid to flow therethrough before and during actuation of a downhole tool. There is yet a further need for actuating a hydraulically actuated tool in a wellbore that contains little or no wellbore fluid. Finally, there is a need for a single trip sidetrack apparatus that contains an actuation apparatus with no moving parts.

SUMMARY OF THE INVENTION

The present invention generally relates to an apparatus and method for operating a tool in a wellbore. In one aspect, the apparatus includes a hydraulically operated tool and a wellbore tubular both in communication with a pressure sensing line. The hydraulically operated tool is responsive to a combination of fluid pressure in the pressure sensing line and manipulation of the wellbore tubular, such response causing the tool to operate within the wellbore.

In another aspect, the wellbore tubular includes a mechanism to create a differential pressure, whereby a higher pressure is created in an upper region above the mechanism and a low pressure is created in a lower region below the mechanism. The mechanism comprises a restriction formed in the wellbore tubular and a seat for a hydraulic isolation device.

In another aspect, the invention provides a method for anchoring a well tool in a wellbore. The method includes the steps of lowering the well tool into the wellbore on a tubular string, flowing fluid through the tubular string to begin anchoring the well tool, and manipulating the tubular string to complete the anchoring of the well tool.

In yet another aspect, the invention provides a method of anchoring a tool in a wellbore that includes the step of lowering the tool on a wellbore tubular into the wellbore, the wellbore having a first portion substantially devoid of liquid. The method further includes the steps of locating the tool in the first portion and flowing fluid through the wellbore tubular to anchor the tool in the first portion.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
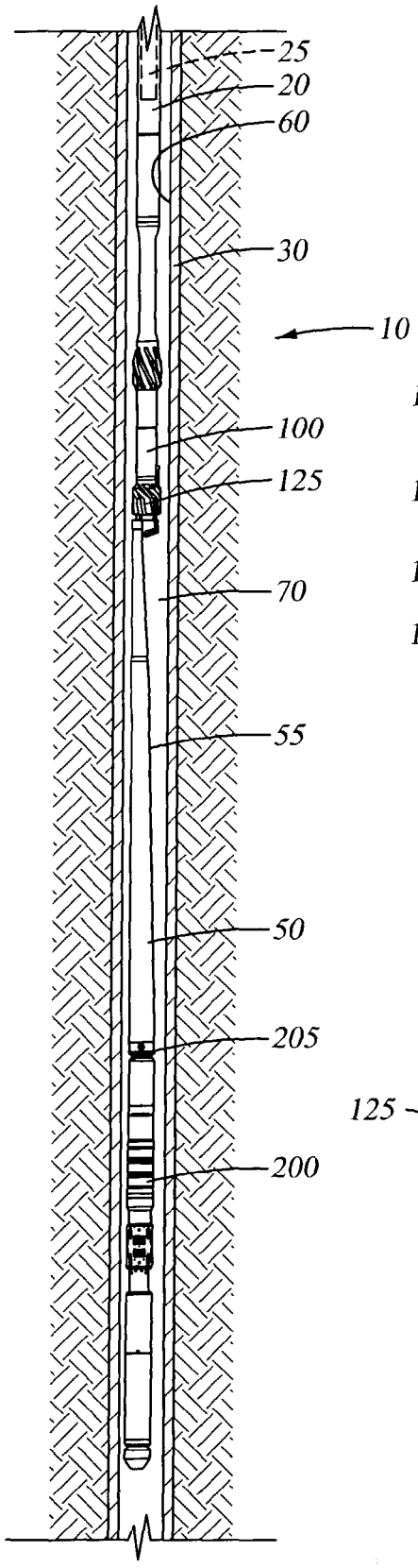
FIG. 1 is an elevation view of a side track system disposed in a wellbore.

This invention provides a sidetrack system 10 useful for offsetting a wellbore by directing a drill bit or cutter at an angle from the existing wellbore. FIG. 1 is an elevation view of the sidetrack system 10 disposed in a wellbore 60. The sidetrack system 10 is shown attached at the lower end of a tubular string 20 and run into the wellbore 60 lined with casing 30. However, the invention is not limited to use in a cased wellbore, but is equally applicable to open, non-cased wellbores. Thus, throughout this disclosure, the term "wellbore" shall refer both to cased wellbore and open wellbore.

The sidetrack system 10 generally includes a MWD device 25, an upper actuation apparatus 100, a window mill 125, a deflector 50, and a hydraulically operated downhole tool 200. The MWD device 25 provides the driller with intelligible information at the surface of wellbore 60 that is representative of the orientation of the sidetrack system 10, and provides a variety of other downhole measurements and data. Typically, the MWD 25 includes a conventional mud pulse telemetry system. The mud pulse telemetry system is well understood by those skilled in the art, thus only a brief description of the system is provided herein. Mud pumps located at the surface of the well circulate drilling mud into the top of the drill string. The mud is conducted through the drill string into the MWD 25 where it passes through a mud pulser that repeatedly interrupts the mud flow to produce a stream of pressure pulses in the circulating drilling mud that can be detected at the surface by pressure transducers. These signals are then analyzed by computer on a continuous basis to determine the inclination, azimuth and other pertinent information that is displayed to an operator by means of a monitor and recorded by a recorder.

The operation of the MWD 25 can be performed without actuating the downhole tool 200 because a greater amount of flow is required to actuate the tool 200 than is required to operate the MWD 25. After operation of the actuation apparatus 100, the downhole tool 200 can be actuated prior to separation of the window mill 125 from the deflector 50. Generally, the deflector 50 or whipstock comprises an elongated tubular member having an inclined face 55 that, once properly oriented in the wellbore 60, is used to deflect the window mill 125 into the casing 30. The deflector 50 is fixed to a bent sub 205 on the downhole tool 200. The bent sub 205 is slightly bent at an angle to ensure the deflector 50 remains flush against the casing 30, thereby allowing the inclined face 55 of the deflector 50 to be oriented to the low side of the casing 30. In addition, the interior of deflector 50 includes a pressure sensing line (not shown) for transmitting pressure from the actuation apparatus 100 to the downhole tool 200 as will be described fully herein. Additionally, the bent sub 205 functions as a point of disconnect between the deflector 50 and the tool 200 in the event the tool 200 becomes immobilized downhole.

In the embodiment illustrated, the downhole tool 200 includes two subassemblies a packer and an anchor. Generally, the packer is a mechanically actuated subassembly that, upon actuation, attaches to the wellbore casing 30 at a predetermined elevation to seal a portion of the wellbore 60 below the packer from a portion above it. While the anchor subassembly is a hydraulically actuated mechanism which, upon delivery of a pressurized fluid at a predetermined pressure becomes set in the casing 30 so as to support deflector 50. The anchor subassembly generally includes a set of slips and cones that fix the sidetrack system 10 in the wellbore 60 as will be described fully herein.

In the preferred embodiment, the downhole tool 200 is actuated by sequential actions of the actuation apparatus 100 and mechanical force supplied by the drill string 20. The components making up the actuation apparatus 100 are visible in FIG. 2. The actuation apparatus 100 is installed in a tubular member 105 above window mill 125. The window mill 125 includes a plurality of cutters 130 and flow ports 135 which provide an exit for fluids pumped through tubular member 105 from the well surface.

Figure 2:
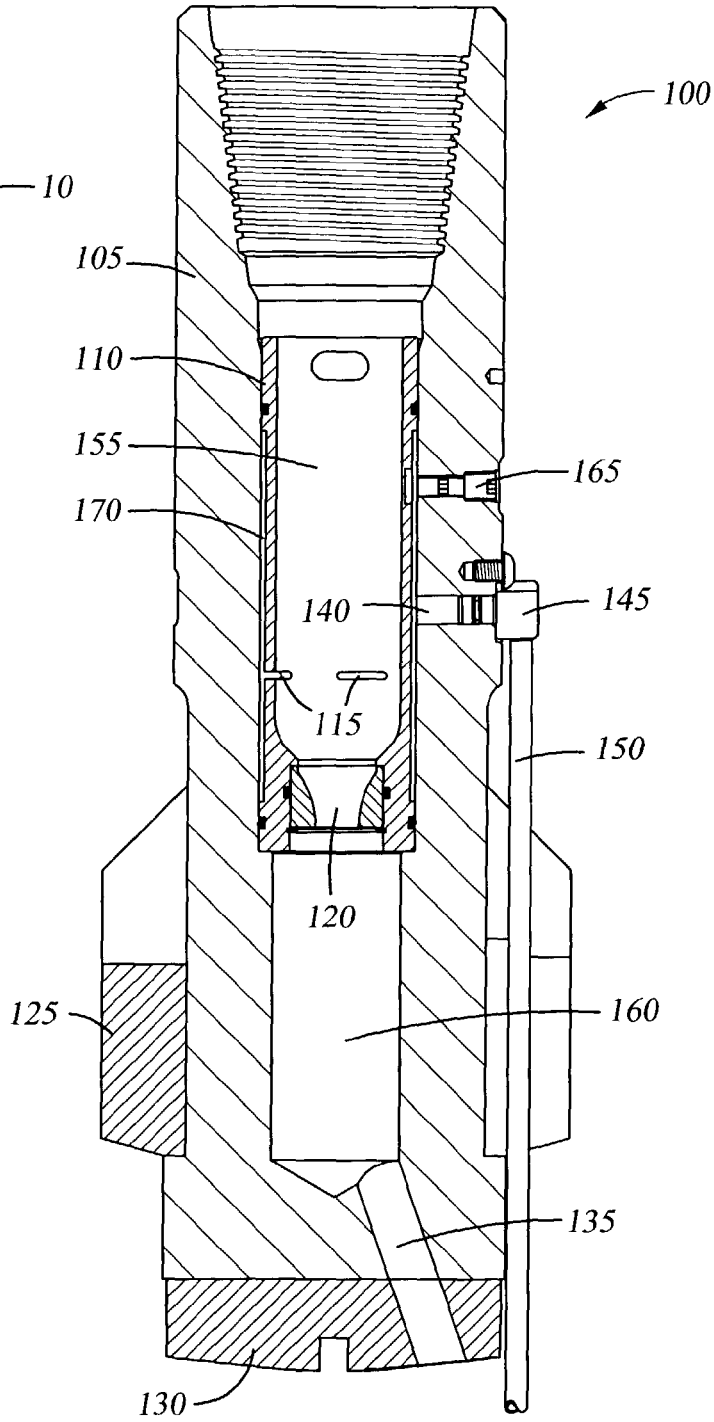
FIG. 2 is a cross-sectional view illustrating one embodiment of an actuation apparatus for use in the sidetrack system.

FIG. 2 is a cross-sectional view illustrating one embodiment of the actuation apparatus 100 for use with the sidetrack system 10. As shown, a sand tube 110 is disposed in the tubular member 105 and secured in place by set screw 165. The sand tube 110 acts as a sand screen to prevent sand from clogging up a pressure port 140 formed in the tubular member 105. The sand tube 110 includes a slit 115 located in region 155 to communicate the change in pressure through an annular area 170 and subsequently into the pressure port 140. The purpose of the annular area 170 is to create a tortuous path and a still space to allow communication of pressure while minimizing any particulate matter entering the port 140. Additionally, the sand tube 110 includes restriction 120 in the inner diameter thereof, which serves to restrict the flow of fluid through tubular member 105. As fluid passes through the actuation apparatus 100 and encounters restriction 120, the pressure of the fluid drops in a region 160 directly below restriction 120 and increases in the region 155 directly above restriction 120, thereby creating a pressure differential between the two regions 155, 160. Conversely, the velocity of the fluid decreases in area 155 and increases in area 160. Formed in a wall of tubular member 105 is the pressure port 140. Connected in fluid communication to pressure port 140 through a fitting 145 is a pressure sensing line 150.

Figure 3:
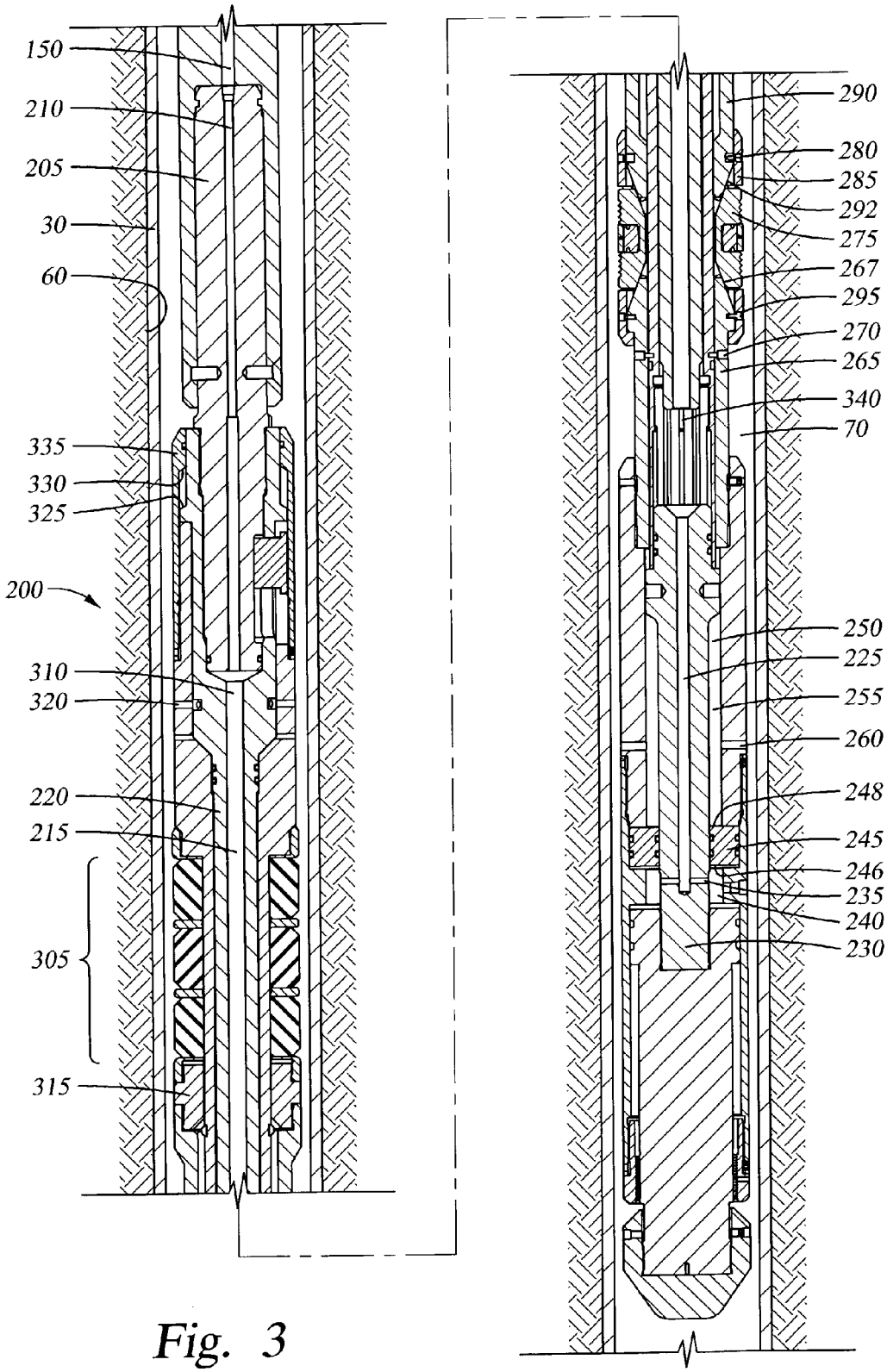
FIG. 3 is a cross-sectional view illustrating a downhole tool in a run-in position.

In order to actuate the tool (not shown), fluid at a predetermined flow rate is applied through the tubular member 105. As fluid moves through restriction 120, a higher pressure is created in region 155. The higher pressure is communicated into the slit 115 in the sand tube 110 through the annular area 170 into the pressure port 140 and subsequently through the pressure sensing line 150 into the tool. The tool 200 as illustrated in FIG. 3 is constructed and arranged to hydraulically actuate a plurality of slips 275 based upon the pressure differential communicated through the pressure sensing line 150. It should be noted that the pressure differential may be created by compressible fluid such as a foam or incompressible fluid such as drilling fluid.

FIG. 3 is a cross-sectional view illustrating the downhole tool 200 in a run-in position. In the preferred embodiment, the fluid pressure in the actuation apparatus 100 is communicated through the pressure sensing line 150 to the downhole tool 200, thereby allowing the piston 245 to be hydrostatically balanced. Generally, the fluid pressure is communicated through the center of the tool 200 through a flow path consisting of a sub bore 210, a stinger bore 310, and a lower body bore 225. Thereafter, the fluid pressure enters cavity 240 through body port 235 that is formed at the lower end of the lower body 230. A force is created on a lower piston surface 246 as the fluid pressure builds in the cavity 240. At the same time, an opposite force is created on the upper piston surface 248 by a hydrostatic pressure that is communicated from an annulus 70 through a housing port 260 into a housing cavity 255. As the force on the lower piston surface 246 becomes greater than the force on the upper piston surface 248, the pressure differential on the piston 245 begins the setting sequence of tool 200. Typically, the annulus 70 in the wellbore 60 contains wellbore fluid, thereby allowing the fluid to be communicated through the housing port 260 to create a fluid pressure against the upper piston surface 248. However, the tool 200 may be hydraulically activated when the annulus 70 does not contain wellbore fluid.

Figure 4:
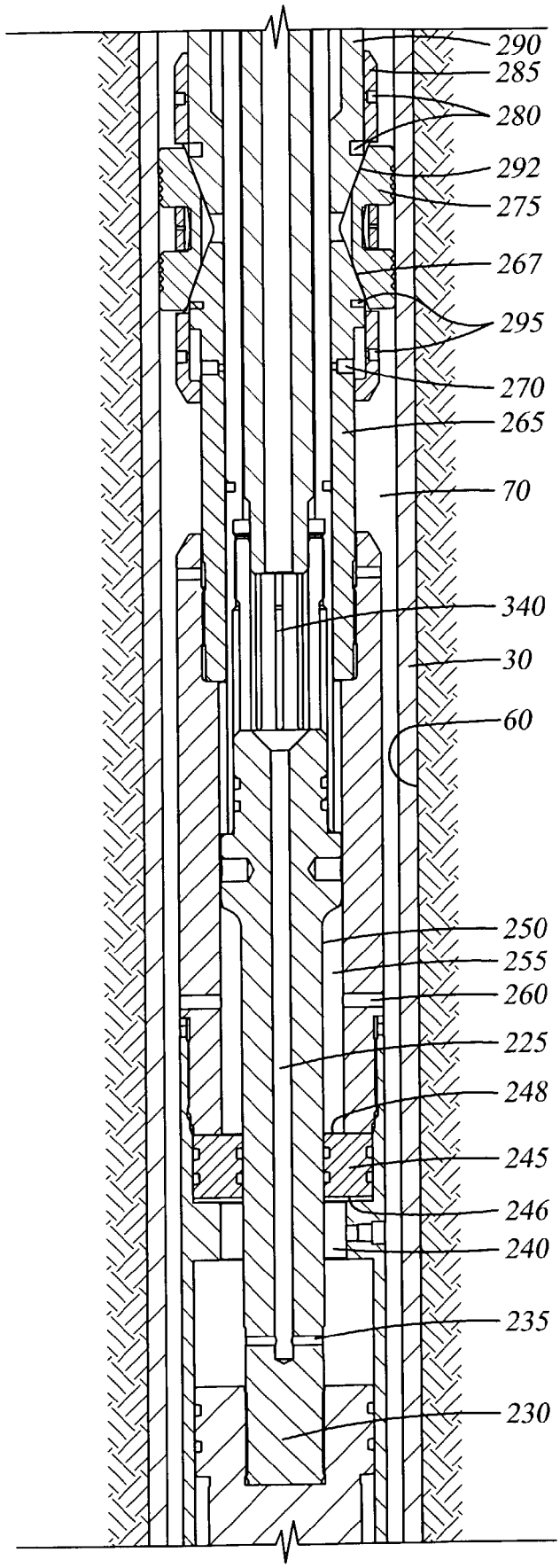
FIG. 4 is a cross-sectional view illustrating the slips expanded radially outward into a surrounding casing to secure the downhole tool in the wellbore.

FIG. 4 is a cross-sectional view illustrating the slips 275 expanded radially outward into the surrounding casing 30 to secure the downhole tool 200 in the wellbore 60. Generally, the more fluid pressure communicated down the center of the tool 200, the more force acting against lower piston surface 246 until a point is reached where the fluid pressure in the tool 200 becomes larger than the pressure acting against the upper piston surface 248. At this point, the fluid pressure in the tool 200 urges the piston 245 upwards toward the bent sub (not shown).

The upward movement of the piston 245 causes a collet housing 250 and lower cone 265 to move upward, thereby shearing pin 270. After the pin 270 fails, the lower cone 265 continues to move upward to act against slips 275. Subsequently, the slips 275 are urged upward to act against housing 285. At a predetermined force, pin 280, which secures the housing 285 to an upper cone 290 fails and allows the upper portion of the slips 275 to ride up a tapered portion 292 of the upper cone 290. As additional fluid force is generated, the force acting on the lower piston surface 246 continues to increase, thereby causing the pin 295 to fail. At this point, a tapered portion 267 on the lower cone 265 is wedged under the slips 275 causing the slips 275 to move radially outward engaging the casing 30. In this manner, the slips 275 are set into the casing 30 securing the tool 200 downhole.

Figure 5:
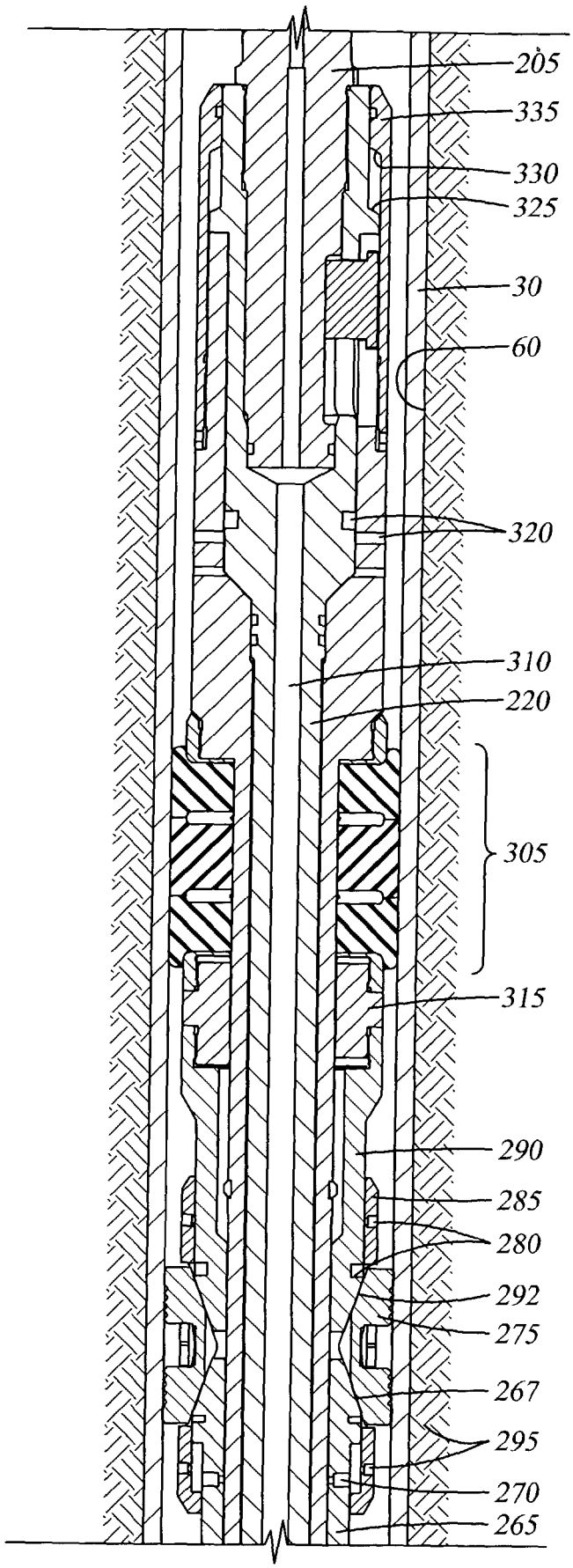
FIG. 5 illustrates a packing element expanded into the surrounding casing to seal off a portion of the wellbore.

FIG. 5 illustrates a packing element 305 expanded into the surrounding casing 30 to seal off a portion of the wellbore 60. After the tool 200 is secured within the casing 30 by the slips 275, the packing element 305 may be expanded. Generally, an uphole mechanical force is applied axially downward on the drill string (not shown) and subsequently applied to the sidetrack system (not shown), which includes the downhole tool 200. As the mechanical force is applied to the downhole tool 200, the slips 275 hold the lower portion of the tool 200 stationary while the bent sub 205 and a stinger 220 are urged axially downward compressing packing element 305 against a cone extension 315. Thereafter, the packing element 305 is urged radially outward into contact with the surrounding casing 30. In this manner, expanding the packing element 305 may seal off the wellbore 60.

Figure 6:
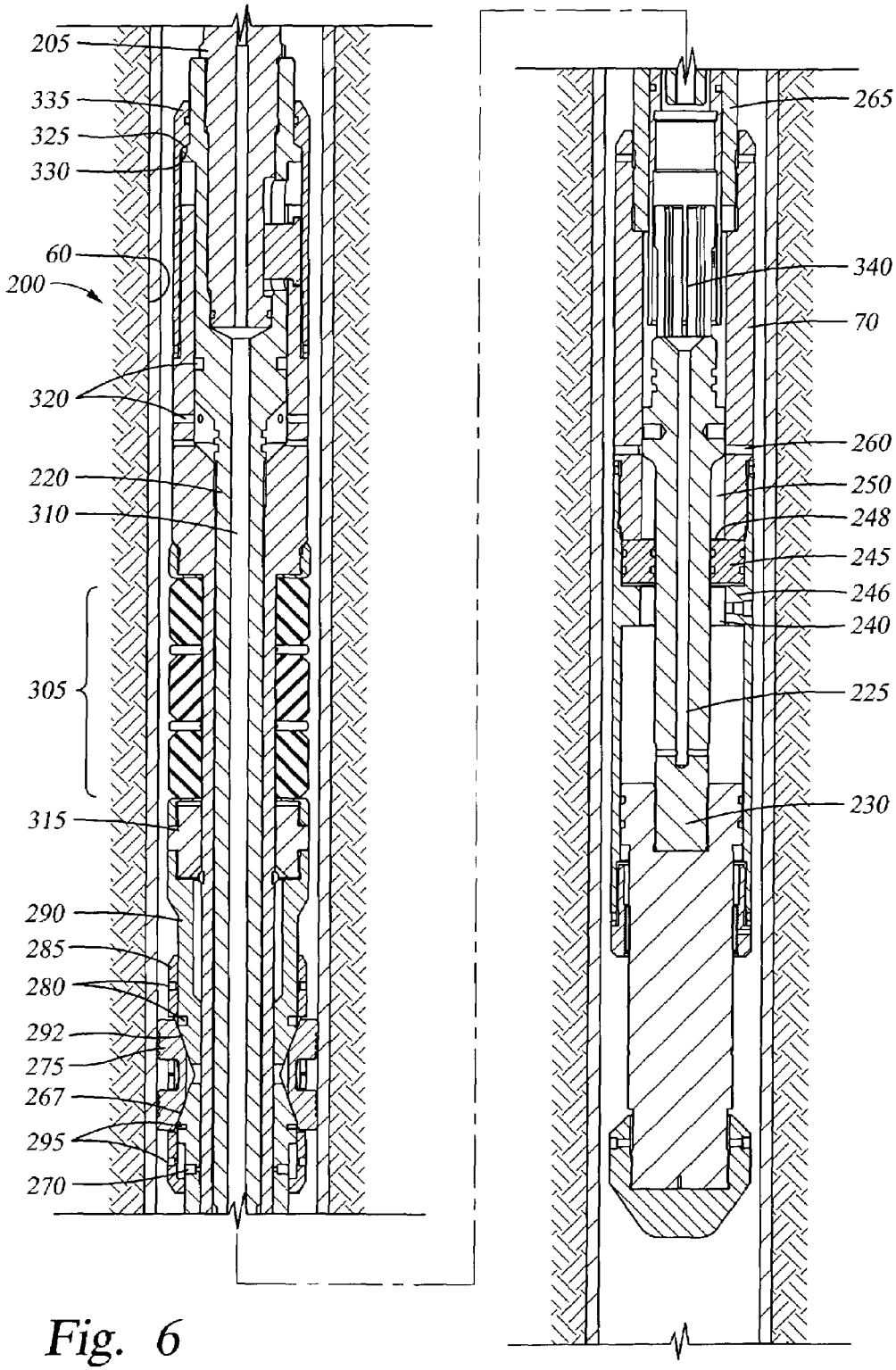
FIG. 6 illustrates the deactivation of the downhole tool.

FIG. 6 illustrates the deactivation of the downhole tool 200. The downhole tool 200 may be removed from the wellbore 60 after the milling operation is complete. Typically, the window mill (not shown), actuation apparatus (not shown), and MWD (not shown) are removed from the wellbore 60 after the milling operation, while the deflector (not shown) and the tool 200 remain downhole. Subsequently, a drill string and fishing tool (not shown) are employed in the well to attach to the deflector. Soon after attachment, the drill string and fishing tool are pulled axially upward causing the deflector to move axially upward and create an axially upward force on the downhole tool 200. At a predetermined force, the tool 200 releasing sequence begins as a plurality of shear screws 320 fail, thereby allowing the stinger 220, which is connected to the bent sub 205, to move axially upward. The stinger 220 continues to move axially upward until a stinger shoulder 325 reaches the retainer shoulder 330. At this point, the lower end of the stinger 220 is pulled out from a plurality of collet fingers 340, thereby allowing the collet fingers 340 to collapse inward. As the releasing sequence unfolds, the bent sub 205 and the stinger 220 act as one upward moving unit causing the packing element 305 to relax, thereby releasing the seal on the surrounding casing 30. At the same time, the tapered portion 292 on the upper cone 290 is pulled axially upward out from under the slips 275 while the slips 275 are pulled off the tapered portion 267 on the lower cone 265, thereby allowing the slips 275 to move radially inward releasing the slips 275 from the surrounding casing 30. In this manner, the downhole tool 200 is released from the surrounding casing 30, thereby allowing the deflector and the tool 200 to be removed from the wellbore 60.

Figure 7:
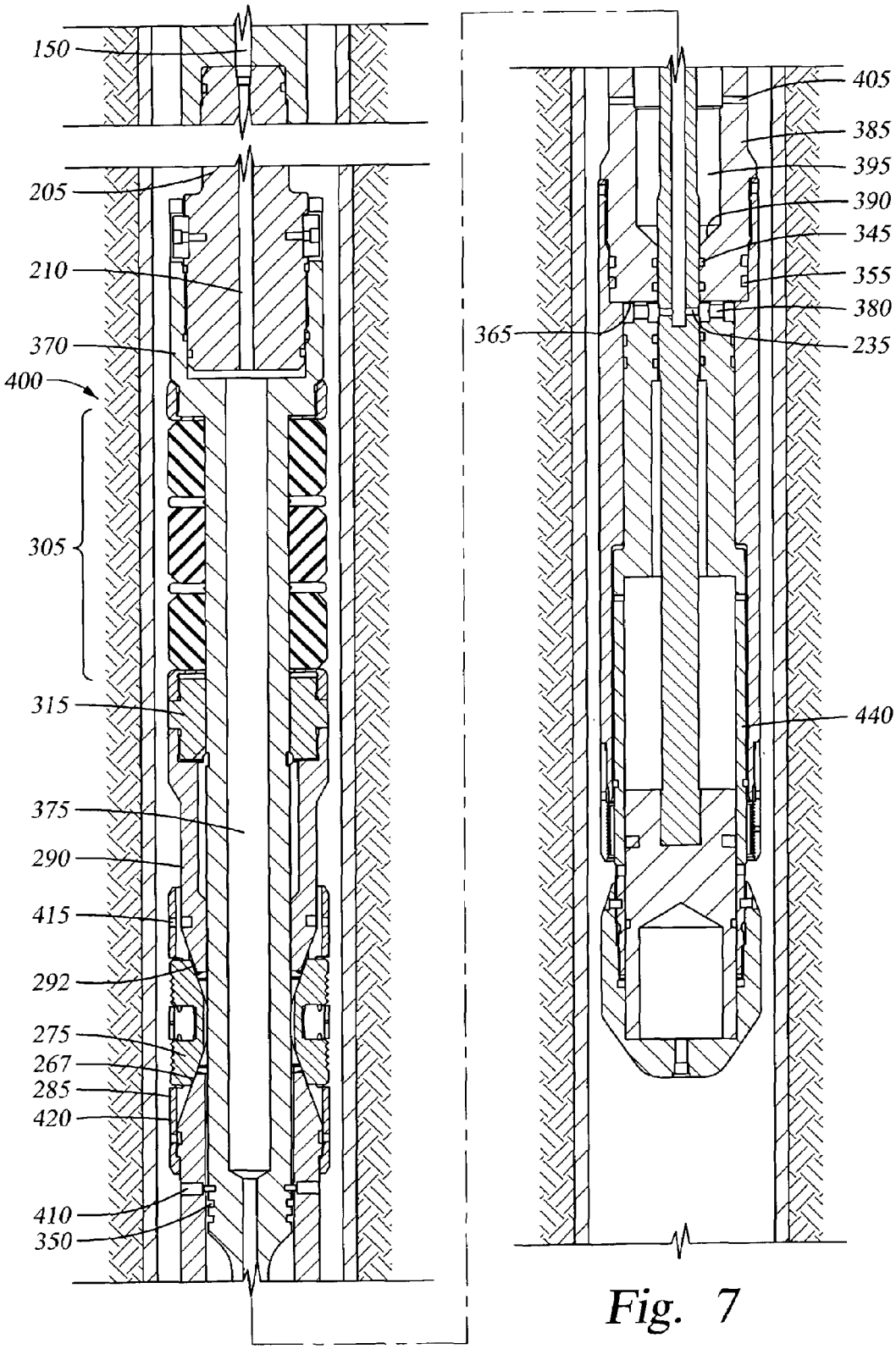
FIG. 7 illustrates an alternative embodiment of a downhole tool in a run-in position.

FIG. 7 illustrates an alternative embodiment of a downhole tool 400 in a run-in position. As shown, downhole tool 400 has similar components as downhole tool 200. Therefore, for convenience, similar components in downhole tool 400 will be illustrated with the same number used in the downhole tool 200. The tool 400 will be actuated by the actuation apparatus (not shown) in the same manner as described for tool 200. Therefore, the pressure differential is communicated through the pressure sensing line 150 into tool 400. The differential pressure travels down the center of the tool 400 through the sub bore 210 and a mandrel bore 375 then exits out port 235 into cavity 380. As the fluid pressure builds up in the cavity 380, a force is created which acts upon a large piston area 360 that is formed between a plurality of outer O-rings 355 disposed on the outer surface of a piston 385 and a plurality of inner O-rings 345 disposed between the inner mandrel 370 and the piston 385.

Figure 8:
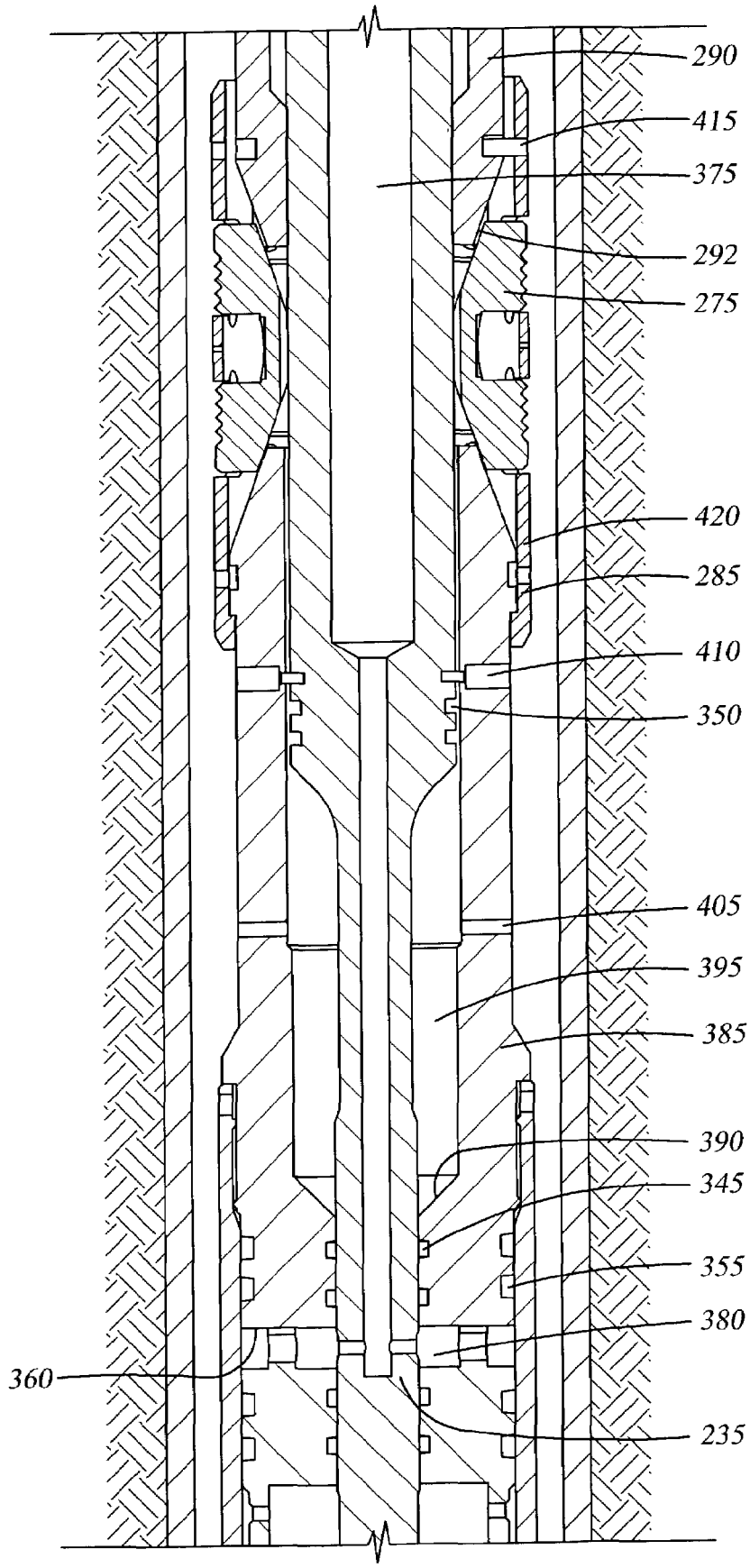
FIG. 8 is an enlarged view illustrating a large piston area prior to setting the slips.

FIG. 8 is an enlarged view illustrating the large piston area 360 prior to setting the slips 275. As illustrated on FIG. 8, the inner O-rings 345 create a fluid tight seal between the piston 385 and mandrel 370. However, the piston 385 does not initially move because an opposite force created by the hydrostatic pressure outside the tool 400 is communicated into a cavity 395 through a port 405 formed in the piston 385 and acts against an inner piston surface 390. As more fluid pressure is communicated down the center of the tool 400, the force acting against large piston area 360 increases until a point is reached when the fluid pressure force acting against the large piston area 360 becomes larger than the hydrostatic pressure force acting against the inner piston surface 390. At this point, the fluid pressure force in the tool 400 causes a shear pin 410 to fail and urges the piston 385 towards the bent sub (not shown).

Figure 9:
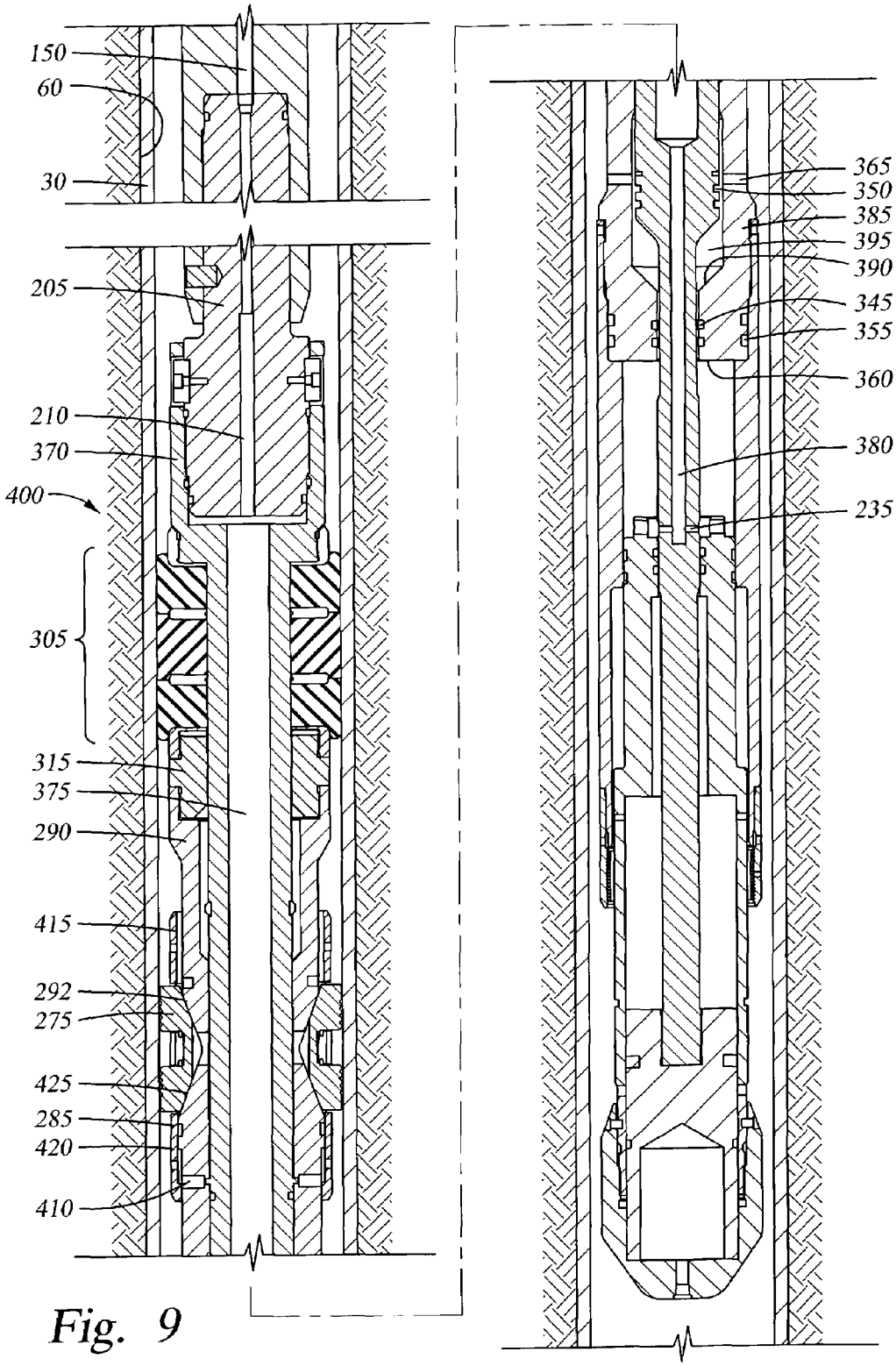
FIG. 9 illustrates the downhole tool after the packing element and slips are set in the surrounding casing.

FIG. 9 illustrates the downhole tool 400 after the packing element 305 and slips 275 are set in the surrounding casing 30. As illustrated, the piston 385 has moved up against slips 275 and housing 285. At a predetermined force, pin 415, which secures the housing 285 to an upper cone 290 fails allowing the upper portion of the slips 275 to ride up the tapered portion 292 of the upper cone 290. As additional fluid force is pumped into the tool 400, the force acting on the large piston area 360 continues to increase, thereby causing the pin 420 to fail. At this point, a tapered portion 425 on the piston 385 is wedged under the slips 275 causing the slips 275 to move radially outward engaging the surrounding casing 30. In this manner, the slips 275 are set into the casing 30 securing the tool 400 downhole.

After the tool 400 is secured within the casing 30, the packing element 305 may be expanded, thereby sealing off a portion of the wellbore 60. Generally, an uphole mechanical force is applied axially downward on the drill string (not shown) and subsequently to the downhole tool 400 in the same manner as previously described. As the mechanical force is applied to the downhole tool 400, the slips 275 hold the lower portion of the tool 400 stationary while the bent sub 205 and the mandrel 370 are urged axially downward compressing packing element 305 against the cone extension 315. Thereafter, the packing element 305 is urged radially outward into contact with the surrounding casing 30. In this manner, expanding the packing element 305 may seal off the wellbore 60.

Figure 10:
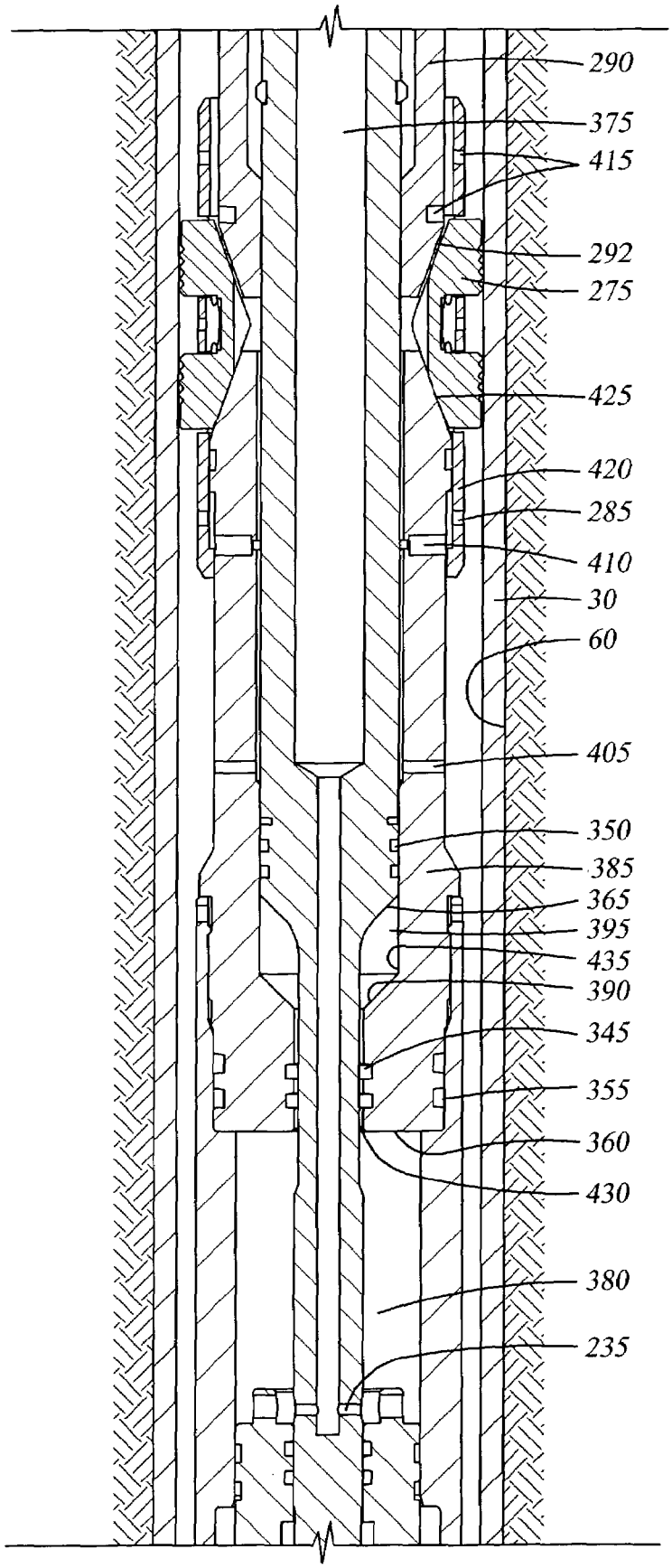
FIG. 10 is an enlarged view illustrating a small piston area after the slips are set.

FIG. 10 is an enlarged view illustrating a small piston area 365 after the slips 275 are set. In addition to expanding the packing element 305, the downward mechanical force changes the location of the mandrel 370, thereby changing the piston area from the large piston area 360 to the small piston area 365. The small piston area 365 is formed between the plurality of outer O-rings 355 disposed on the outer surface of the piston 385 and a middle O-ring 350 disposed on the mandrel 370. As shown on FIG. 10, the mandrel 370 has moved axially toward the lower end of the tool 400. The downward movement of mandrel 370 creates a gap 430 between the inner O-rings 345 and the mandrel 370. In other words, the gap 430 breaks the fluid tight seal created between the mandrel 370 and the piston 385, thereby allowing fluid communication past the inner O-rings 345 into the cavity 380. Additionally, the middle O-ring 350 disposed on the mandrel 370 contacts an inner surface 435 to create a fluid tight seal between the piston 385 and the mandrel 370. Therefore, any fluid in the cavity 380 no longer acts upon the large piston area 360 but rather acts upon a small piston area 365. In this respect, the smaller piston area 365 reduces the forces on the tool 400, such as the shear release when the tool 400 is under pressure. In other words, the small piston area 365 allows the tool 400 to operate in high downhole pressure where there is a large pressure differential between the internal and the external portions of the tool 400. Additionally, the sealing element 305 and slips 275 are shear released from the surrounding casing by shearing pin 440 in a similar manner as described for downhole tool 200, thereby allowing the downhole tool 400 to be removed from the wellbore 60.

Figure 11:
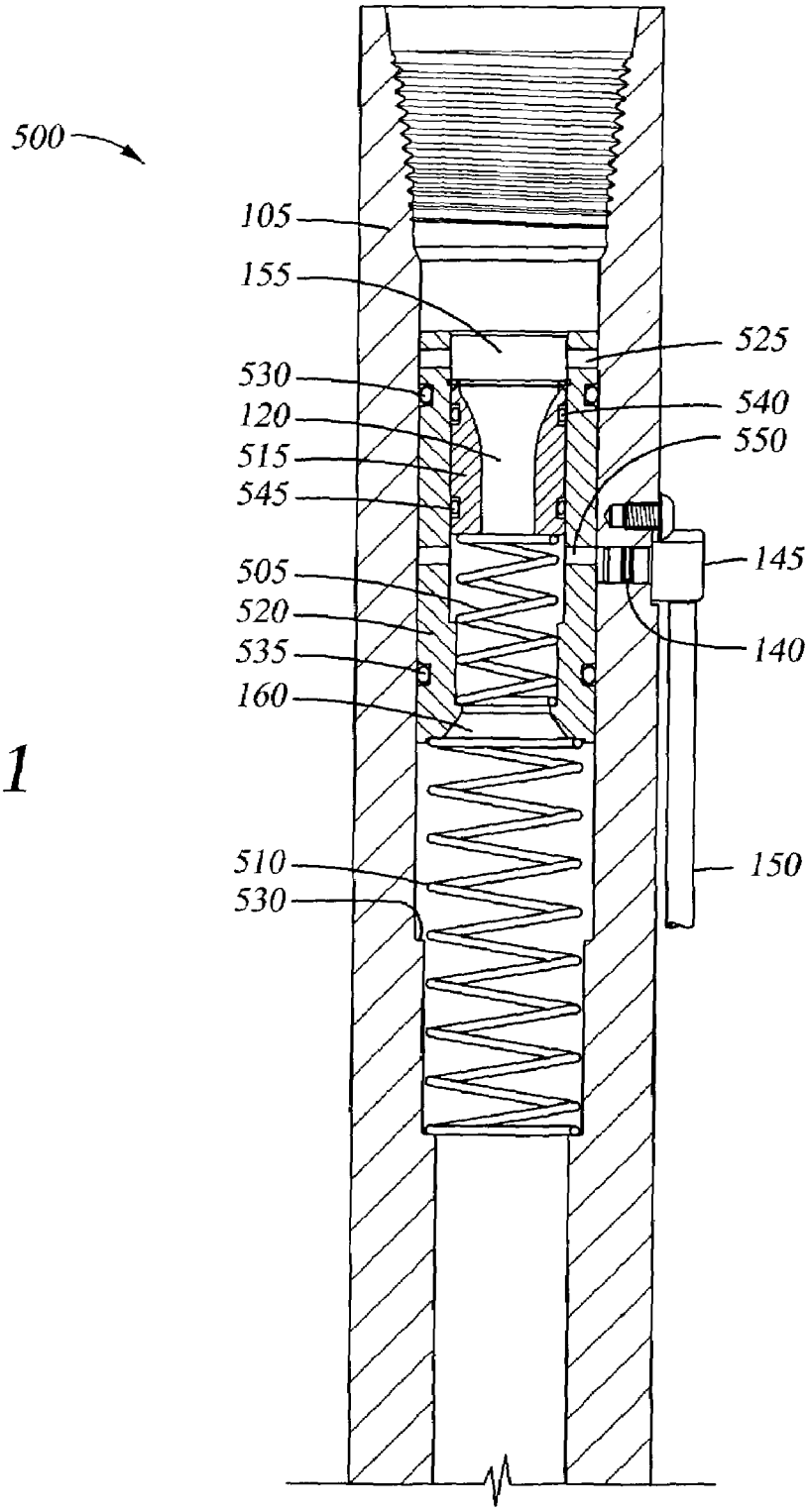
FIG. 11 is a cross-sectional view illustrating an alternative embodiment of an actuation apparatus in the run-in position.

FIG. 11 is a cross-sectional view illustrating an alternative embodiment of an actuation apparatus 500 in the run-in position. As shown, actuation apparatus 500 has similar components as actuation apparatus 100. Therefore, for convenience, similar components in actuation apparatus 500 will be illustrated with the same number used in the actuation apparatus 100. The apparatus 500 includes an inner sleeve 515 that moves between a first position and a second position. A biasing member called an inner spring 505 biases the inner sleeve 515 upward in the first position. The spring 505 is constructed and arranged to shift inner sleeve 515 to the second position at a predetermined flow rate through the actuation apparatus 500. The force exerted upon the inner spring 505 is determined by the flow rate and pressure of fluid through apparatus 500.

Inner sleeve 515 includes restriction 120 in the inner diameter thereof, which serves to restrict the flow of fluid through tubular member 105. As fluid passes through actuation apparatus 500 and encounters restriction 120, the pressure of the fluid drops in the region 160 directly below restriction 120 and increases in a region 155 directly above restriction 120 thereby creating a pressure differential between the two regions 155, 160. Conversely, the velocity of the fluid decreases in area 155 and increases in area 160. The inner sleeve 515 further includes O-rings 540, 545 disposed on the outer surface of the inner sleeve 515 to create a fluid tight seal between the inner sleeve 515 and an outer sleeve 520. Additionally, the pressure port 140 is formed in a wall of tubular member 105. Connected in fluid communication to pressure port 140 through the fitting 145 is the pressure sensing line 150. As depicted in FIG. 11, when the upper actuation apparatus 500 is not activated, the pressure sensing line 150 is in communication with lower pressure region 160 below the restriction 120.

The outer sleeve 520 is disposed on the inner surface of the actuation apparatus 500. The outer sleeve 520 is shifts between a first and a second position. As illustrated, the outer sleeve 520 is biased in the first position by an outer spring 510. The outer spring 510 is constructed and arranged to allow the outer sleeve 520 to shift to the second position at a predetermined flow rate through the actuation apparatus 500. As depicted, O-rings 530, 535 are disposed around the outer surface of the outer sleeve 520 to create a fluid tight seal between the outer sleeve 520 and the tubular member 105. Additionally, an upper port 525 and a lower port are formed in the outer sleeve 520 to allow fluid communication between regions 155, 160 and the port 140.

Figure 12:
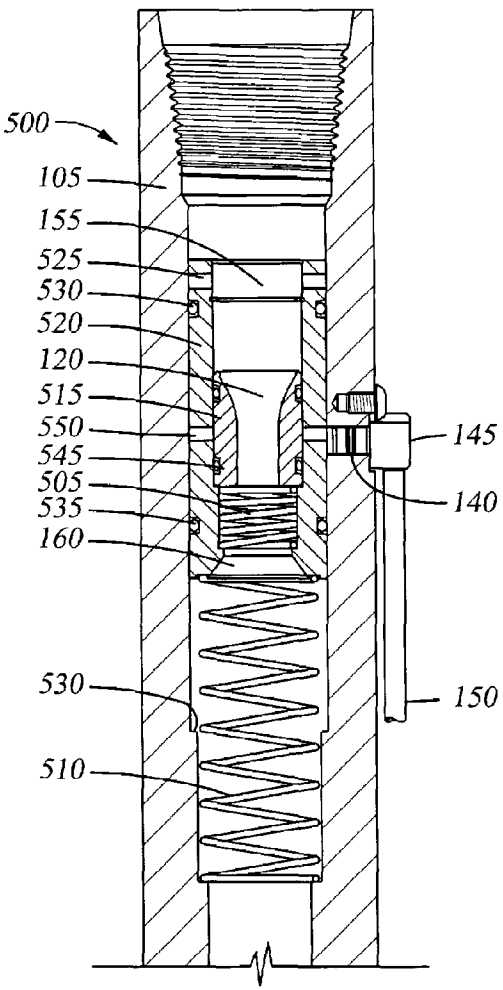
FIG. 12 is a cross-sectional view illustrating the flow rate through the actuation apparatus to operate a MWD device.

FIG. 12 is a cross-sectional view illustrating the flow rate through the actuation apparatus 500 to operate the MWD device (not shown). The actuation apparatus 500 is constructed and arranged to pass a flow rate of fluid therethrough sufficient to operate a MWD device located in a running string without actuating a hydraulically operated tool (not shown) therebelow. During operation of the MWD, fluid is pumped through the actuation apparatus 500 at a level that creates a force in the restriction 120 sufficient to overcome the inner spring 505, causing the inner sleeve 515 to move to the second position. At this point, the fluid communication through the lower port 550 and the port 140 is blocked as illustrated on FIG. 12. In this manner, the MWD may be operated without actuating the downhole tool. After operation of the MWD, the flow rate may be increased to that level that creates a force sufficient to overcome the outer spring 510 as shown in FIG. 13.

Figure 13:
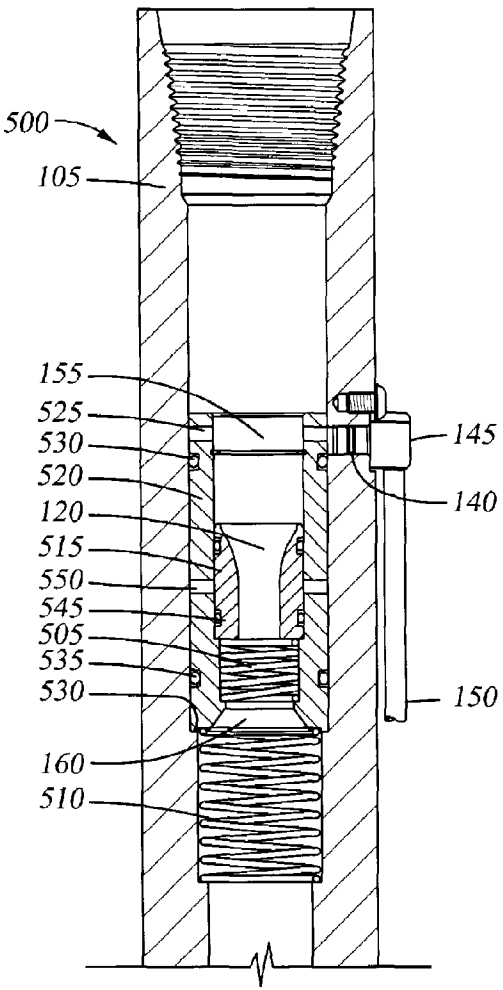
FIG. 13 is a cross-sectional view illustrating the flow rate through the actuation apparatus to actuate the downhole tool.

FIG. 13 is a cross-sectional view illustrating the flow rate through the actuation apparatus 500 to actuate the downhole tool (not shown). In order to actuate the apparatus 500, fluid at a predetermined flow rate is applied through tubular member 105. As the fluid moves through restriction 120, pressure rises in region 155. At a predetermined flow rate, the force at restriction 120 is adequate to overcome the outer spring 510. Thereafter, the outer sleeve 520 will move to the second position against shoulder 530 as illustrated in FIG. 13. At the same time, the actuation apparatus 500 places the pressure sensing line 150 in fluid communication with region 155 above the restriction 120. In this respect, the pressure sensing line 150 is exposed to the higher pressure created by the flow of fluid through restriction 120. The pressure sensing line 150 communicates the higher pressure in the same manner as described in the actuation apparatus 100.

Figure 14:
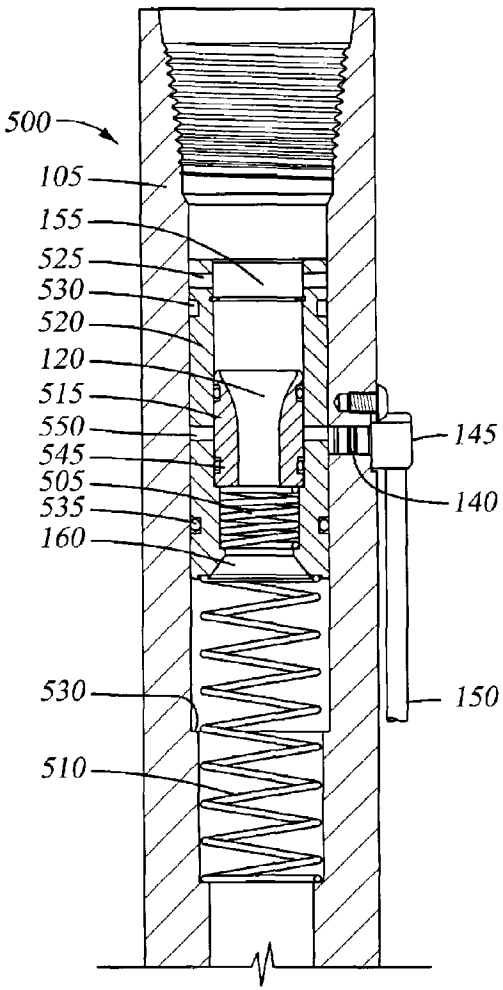
FIG. 14 is a cross-sectional view illustrating the flow rate through the actuation apparatus after the downhole tool is actuated.

FIG. 14 is a cross-sectional view illustrating the flow rate through the actuation apparatus 500 after the downhole tool (not shown) is actuated. As the flow rate decreases, the force in the restriction 120 becomes insufficient to overcome the outer spring 510, causing the outer sleeve 520 to move from the second position to the first position. As further illustrated, the port 140 remains isolated to prevent the possibility of erosion and damage to the downhole tool during the milling operation. Subsequently, the flow rate is further decreased allowing the apparatus 500 to return to the run-in position as illustrated on FIG. 11.

Figure 15:
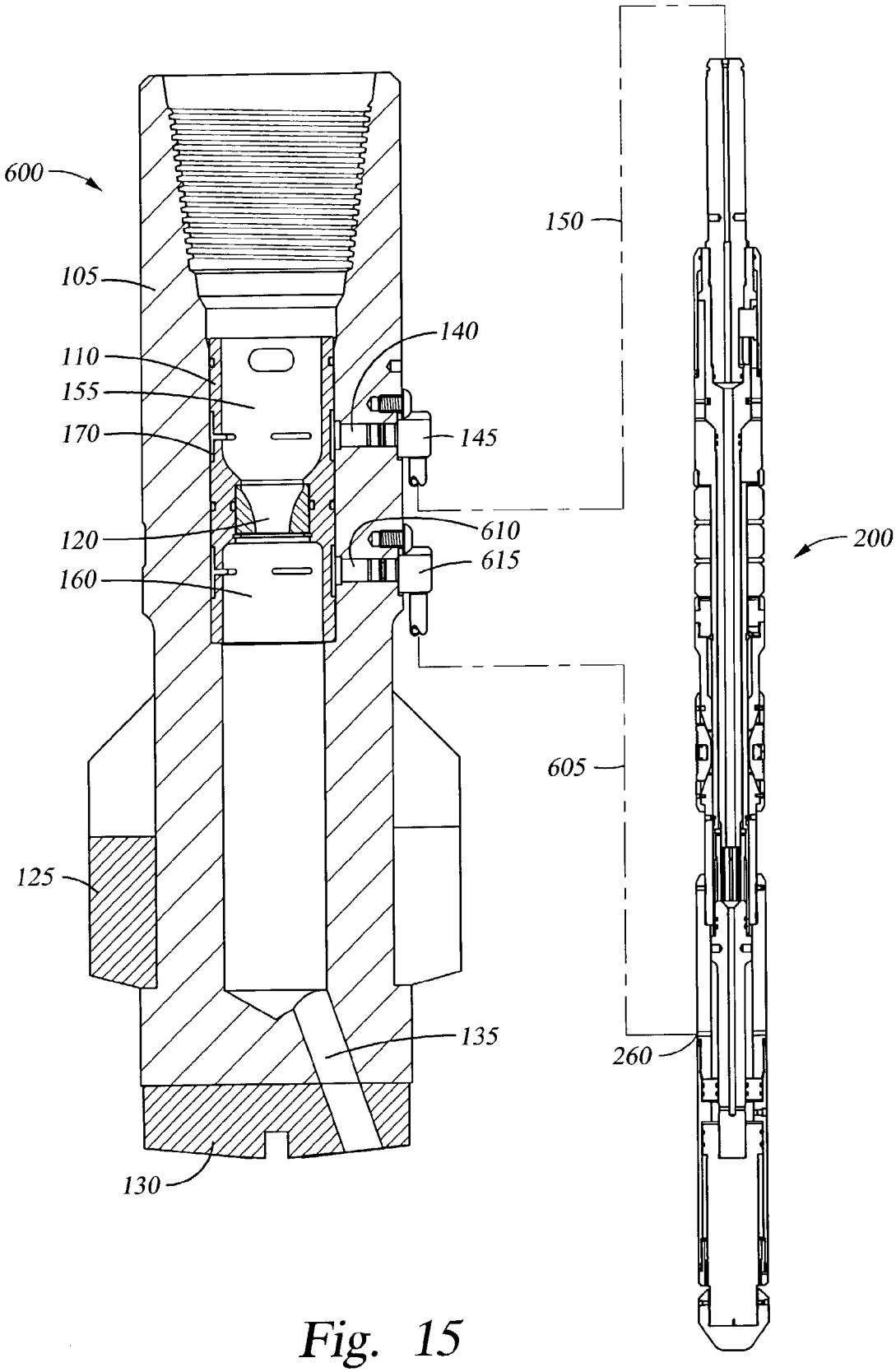
FIG. 15 is a cross-sectional view illustrating an alternative embodiment of an actuation apparatus.

FIG. 15 is a cross-sectional view illustrating an alternative embodiment of an actuation apparatus 600. As shown, actuation apparatus 600 has similar components as actuation apparatus 100. Therefore, for convenience, similar components in actuation apparatus 600 will be illustrated with the same number used in the actuation apparatus 100. As previously discussed for tool 200, the hydrostatic pressure enters the housing port 260 from wellbore fluid in the annulus (not shown). Alternatively, the hydrostatic pressure may be communicated to the housing port 260 through a low-pressure line 605. The low-pressure line 605 is connected to a fitting 615 housed in a low-pressure port 610 formed in a wall of tubular member 105. The low-pressure port 610 is in fluid communication with region 160 directly below restriction 120. In this respect, the actuating apparatus 600 completely eliminates any effective pressure drop across the mill face, thereby providing an effective means of actuating the tool 200.

Figure 16:
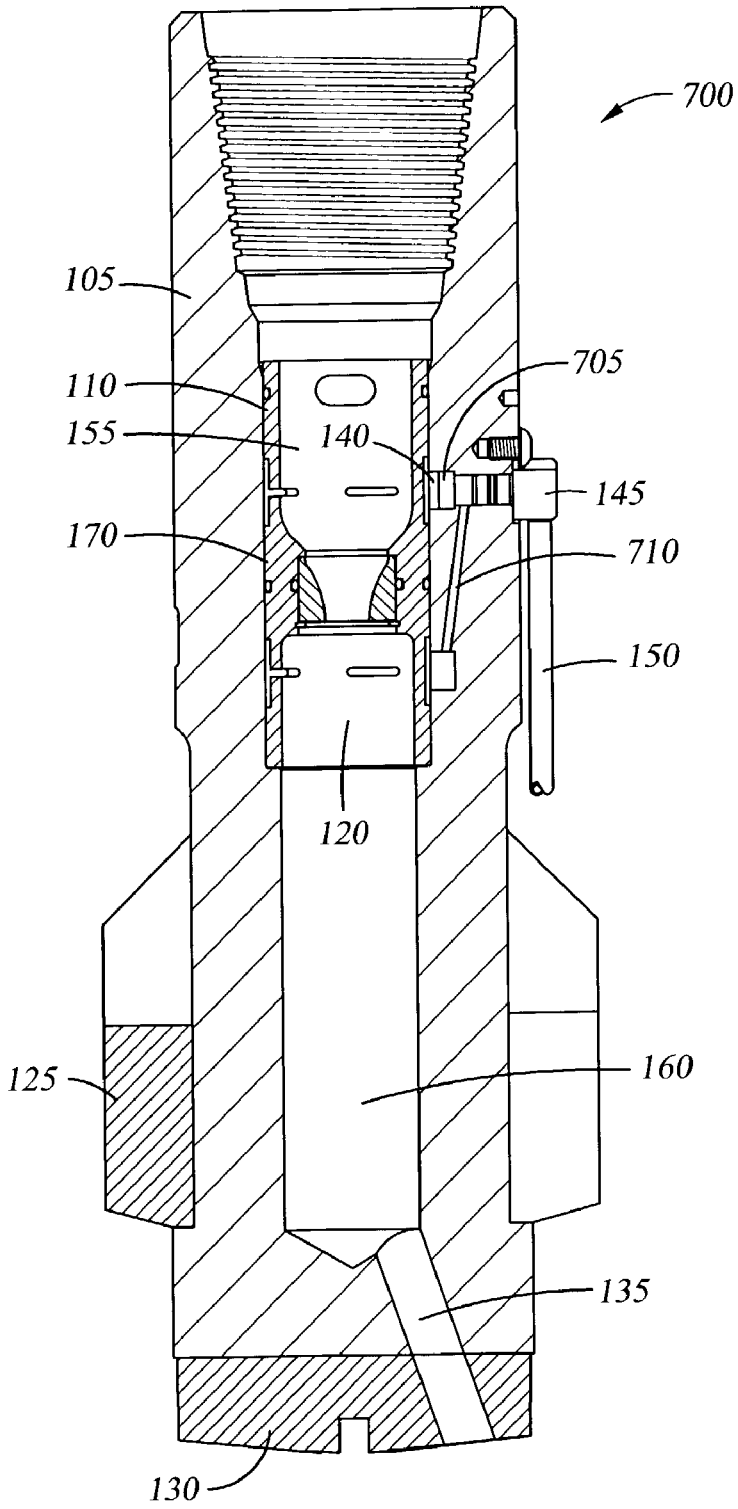
FIG. 16 is a cross-sectional view illustrating an alternative embodiment of an actuation apparatus.

FIG. 16 is a cross-sectional view illustrating an alternative embodiment of an actuation apparatus. As shown, actuation apparatus 700 has similar components as actuation apparatus 100. Therefore, for convenience, similar components in actuation apparatus 700 will be illustrated with the same number used in the actuation apparatus 100. As previously discussed for actuation apparatus 100, the tool (not shown) is activated or triggered by a differential pressure in regions 155, 160 created by fluid flow through the restriction 120. However, flow rate may vary due to pulsing of the pumps and other restrictions in the flow line. Therefore, the embodiment illustrated in actuation apparatus 700 contains a control feature that allows the tool to be activated or triggered at a predetermined pressure. As shown, a single use valve or a rupture disk 705 is placed in the pressure port 140. In addition, a fluid port 710 fluidly connects region 160 to the pressure port 140 to form a Y block. In the embodiment shown, the single use valve is a rupture disk to permit activation of the tool at a predetermined pressure. However, other forms of single use valves may be employed, such as a pressure relief valve, so long as they are capable of allowing activation of the tool at a predetermined pressure. In operation, the actuation apparatus 700 functions in the same manner as previously discussed for actuation apparatus 100. However, the rupture disk 705 in the actuation apparatus 700 buffers out fluid pulses created by the pumps by requiring a threshold trigger pressure to be reached prior to activation of the tool. In this respect, the actuation apparatus 700 provides an external control feature to activate the tool rather than relying on the shear screws internal to the tool.

Figure 17:
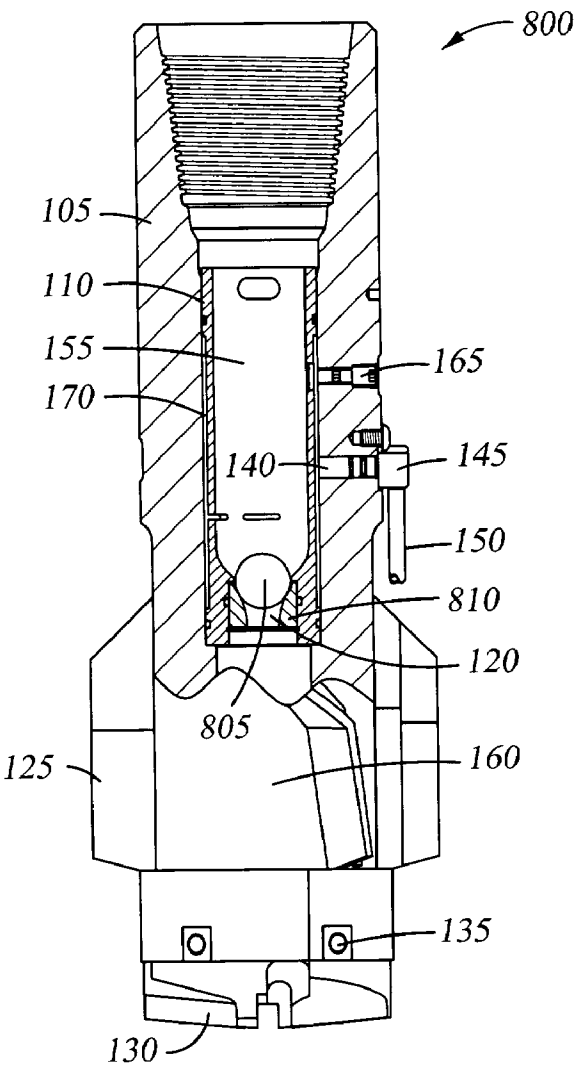
FIG. 17 is a cross-sectional view illustrating an alternative embodiment of an actuation apparatus with a hydraulic isolation device.

FIG. 17 is a cross-sectional view illustrating an alternative embodiment of an actuation apparatus 800 with a hydraulic isolation device 805. As shown, actuation apparatus 800 has similar components as actuation apparatus 100. Therefore, for convenience, similar components in actuation apparatus 800 will be illustrated with the same number used in the actuation apparatus 100. In this embodiment, the restriction 120 is used as a seat 810 for a hydraulic isolation device 805. In the embodiment shown, the hydraulic isolation device 805 is a ball. However, other forms of hydraulic isolation devices may be employed, such as a dart, so long as they are capable of restricting the flow of fluid through the tubular member 105. The hydraulic isolation device 805 may be dropped from the surface of the wellbore (not shown) into the drill string (not shown). Thereafter, the hydraulic isolation 805 device would flow through the tubular member 105 and land in the seat 810. As fluid is pumped through the drill string and subsequently through the actuation apparatus 800, the hydraulic isolation device 805 would restrict the flow through the tubular member 105 and create a pressure in the region 155. The higher pressure is communicated through the slit 115 of the sand tube 110 to the pressure port 140 and subsequently through the pressure sensing line 150 to activate the tool (not shown) as described in the previous paragraph.

Figure 18:
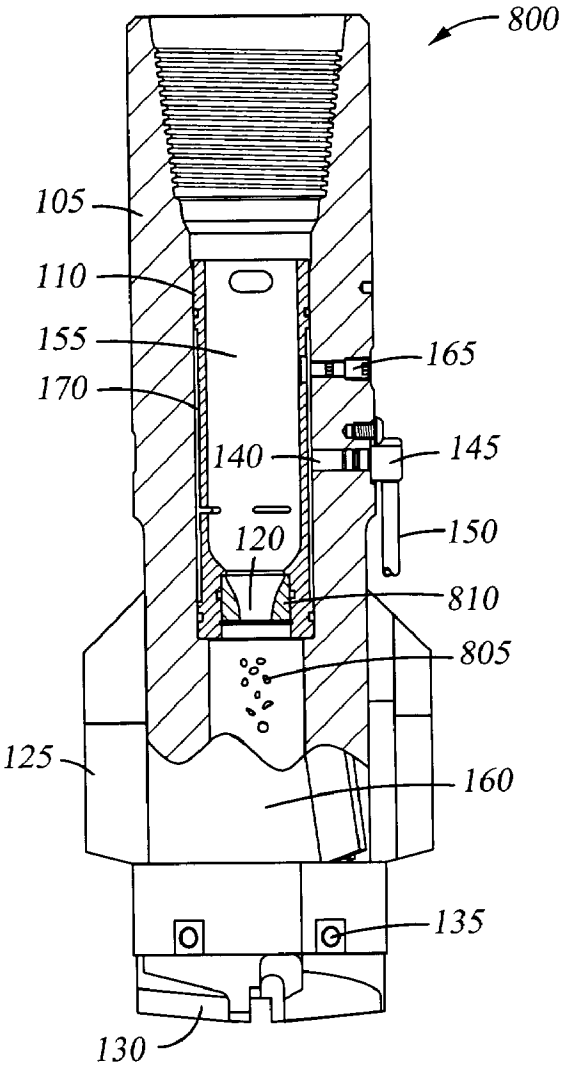
FIG. 18 is a cross-sectional view illustrating the removal of the hydraulic isolation device from the actuation apparatus.

FIG. 18 is a cross-sectional view illustrating the removal of the hydraulic isolation device 805 from the actuation apparatus 800. After the tool (not shown) has been hydraulically actuated, the fluid flow rate may be increased to remove the hydraulic isolation device 805 from the seat 810. For example, if the isolation device 805 is a ball, the flow rate may be increased to create a force on the ball, whereby at a predetermined force the ball explodes and the residue is washed out through the flow ports 135 as illustrated in FIG. 18.

In operation, a sidetrack system is disposed in a wellbore. The sidetrack system is useful for offsetting a wellbore by directing a drill bit or cutter at an angle from the existing wellbore. The sidetrack system typically includes a window mill, an actuation apparatus, a MWD, a deflector and a downhole tool such as an anchor-packer. To operate the sidetrack system and actuate the downhole tool fluid is pumped from the surface of the wellbore through a drill string and subsequently through the actuation apparatus. As fluid passes through the actuation apparatus and encounters a restriction, the pressure of the fluid drops in a region directly below the restriction and increases in the region directly above the restriction, thereby creating a pressure differential between the two regions. The pressure differential is communicated into a slit in the sand tube through the annular area into the pressure port and subsequently through the pressure sensing line into the center of the tool. Thereafter, the fluid pressure enters a cavity through a body port that formed at the lower end of the lower body. As the fluid pressure builds up in the cavity a force is created which acts upon a lower piston surface.

Generally, the more fluid pressure communicated down the center of the tool, the more force acting against lower piston surface until a point is reached when the force on the lower piston surface becomes larger than the opposite force acting against the upper piston surface. At this point, the piston is urged upwards toward the bent sub. The movement of the piston causes a plurality of shear members to fail and subsequently urges the tapered portions on the lower cone and upper cone to wedge under the slips causing the slips to move radially outward into contact with the casing. Thereafter, an uphole mechanical force is applied axially downward on the drill string and subsequently applied to the downhole tool. As the mechanical force is applied to the downhole tool, the slips hold the lower portion of the tool stationary while a bent sub and a stinger are urged axially downward compressing the packing element against the cone extension, thereby causing the packing element radially outward into contact with the surrounding casing. In this manner, the downhole tool is operated in the wellbore.

The downhole tool may be removed from the wellbore after the milling operation is complete. Typically, the window mill, actuation apparatus, and MWD are removed from the wellbore after the milling operation, while the deflector and the downhole tool remain in the wellbore. Subsequently, a drill string and fishing tool are employed in the well to attach to the deflector. Soon after attachment, the drill string and fishing tool are pulled axially upward causing the deflector to move axially upward and create an axially upward force on the downhole tool. The axially upward force causes the packing element and slips to release allowing the downhole tool and the deflector to be removed from the wellbore.

While the foregoing is directed to embodiments of the present invention, other and further embodiments of the invention may be devised without departing from the basic scope thereof, and the scope thereof is determined by the claims that follow.

The invention claimed is:

1. An apparatus for operating a tool in a wellbore, the apparatus comprising;

a hydraulically operated tool in communication with a pressure sensing line; and a wellbore tubular having an upper region separated from a lower region by a restriction, whereby a higher fluid pressure is created in the upper region and a lower fluid pressure is created in the lower region, wherein the higher fluid pressure is communicated through the pressure sensing line to create a force on a piston in the hydraulically operated tool, thereby causing the piston to move and urge a plurality of slips in the hydraulically operated tool radially outward into contact with a surrounding casing, thereafter manipulation of the wellbore tubular applies an axial force to the hydraulically operated tool to compress a packing element disposed on the hydraulically operated tool.

2. The apparatus of claim 1, wherein the hydraulically operated tool further includes a low pressure line in communication with the lower region in the wellbore tubular.

3. The apparatus of claim 1, wherein the fluid pressure is created by an incompressible fluid.

4. The apparatus of claim 1, wherein the fluid pressure is created by a compressible fluid.

5. The apparatus of claim 1, wherein the hydraulically operated tool includes an angled connection means to allow an inclined face of a deflector to remain flush against a surrounding casing, thereby allowing the inclined face to be oriented to a low side of the casing.

6. The apparatus of claim 1, whereby the hydraulically operated tool is an anchor.

7. The apparatus of claim 1, wherein the piston is movable between a first and a second position.

8. The apparatus of claim 7, wherein the piston in the first position defines a large piston area, whereby the fluid pressure acting on the large piston area activates the hydraulically operated tool and shifts the piston to the second position.

9. The apparatus of claim 7, wherein the piston in the second position defines a small piston area, whereby the fluid pressure acting on the small piston area prevents damage to the hydraulically operated tool.

10. A method for anchoring a well tool in a wellbore, comprising:

lowering the well tool into the wellbore on a tubular string;

flowing fluid through the tubular string to begin anchoring the well tool;

creating a fluid pressure by a restriction in the tubular string, whereby a higher pressure is created in an upper region above the restriction and a lower pressure is created in a lower region below the restriction;

supplying the higher pressure to a piston in the well tool, thereby causing the piston to move axially upward against a plurality of slips disposed on the well tool to shear a shear member and then cause the plurality of slips to move radially outward into contact with a surrounding casing;

applying a downward axial force to the well tool to compress a packing element disposed on the well tool; and manipulating the tubular string to complete the anchoring of the well tool.

11. The method of claim 10, further including supplying an axially upward force to the well tool to release the slips and the packing element and thereafter remove the well tool from the wellbore.

12. A method of anchoring a tool in a wellbore, comprising:

lowering the tool on a wellbore tubular into the wellbore, the wellbore having a first portion substantially devoid of liquid;

locating the tool in the first portion;

flowing fluid through the wellbore tubular to activate a plurality of slips to anchor the tool in the first portion; and applying a downward mechanical axial force to the well tool to compress a packing element disposed on the well tool.

13. An apparatus for operating a tool in a wellbore, the apparatus comprising;

a body;

a stationary sleeve disposed in the body, the sleeve having a restriction in an inner portion thereof;

a pressure port in fluid communication with the inner portion of the sleeve above the restriction, wherein the pressure port is capable of connection to a pressure line for operating the tool; and an annular area defined between the sleeve and the body, wherein the annular area is in communication with the inner portion and the pressure port and the annular area is constructed and arranged to substantially eliminate movement of particulate matter into the pressure line through the pressure port.

14. The apparatus of claim 13, whereby the restriction is constructed and arranged to receive a hydraulic isolation device.

15. The apparatus of claim 13, further including a second pressure port in communication with the inner portion below the restriction.

16. The apparatus of claim 15, wherein the sleeve comprises:

first one or more openings providing fluid communication between the inner portion of the sleeve above the restriction and the first pressure port; and second one or more openings providing fluid communication between the inner portion of the sleeve below the restriction and the second pressure port.

17. The apparatus of claim 13, further including a pressure sensing member disposed in line with the pressure port, whereby the pressure sensing member is constructed and arranged to open at a predetermined pressure.

18. An apparatus for operating a tool in a wellbore, the apparatus comprising:

a hydraulically operated tool in communication with a pressure sensing line; and a welibore tubular having an upper region separated from a lower region by a restriction and a seat capable of receiving a hydraulic isolation device, whereby a higher fluid pressure is created in the upper region and a lower fluid pressure is created in the lower region, wherein the higher fluid pressure is communicated through the pressure sensing line to create a force on a piston in the hydraulically operated tool, thereby causing the piston to move and urge a plurality of slips in the hydraulically operated tool radially outward into contact with a surrounding casing, thereafter manipulation of the wellbore tubular applies an axial force to the hydraulically operated tool to compress a packing element disposed on the hydraulically operated tool.

19. The apparatus of claim 18, wherein the hydraulic isolation device is dropped from a surface of the wellbore to block the flow of fluid and create the higher pressure in the upper region.

20. The apparatus of claim 18, wherein the pressure sensing line communicates with at least one of the regions.

* * * * *